United States Patent [19]

Kashden

[11] 4,382,640

[45] May 10, 1983

[54] PORTABLE STORAGE SHELF UNIT

[75] Inventor: R. Paul Kashden, Hewlett, N.Y.

[73] Assignee: Closet Systems Corp., Hewlett, N.Y.

[21] Appl. No.: 215,378

[22] Filed: Dec. 11, 1980

[51] Int. Cl.[3] ..... A61G 11/00

[52] U.S. Cl. ..... 312/5; 108/149; 108/152; 312/3; 312/258

[58] Field of Search ..... 312/4, 3, 5, 6, 258; 211/90, 96; 108/149, 152

[56] References Cited

U.S. PATENT DOCUMENTS

| | | | |
|---|---|---|---|
| 1,375,883 | 4/1921 | Woolson | 312/6 |
| 1,569,406 | 1/1926 | Sonntag | 312/5 |
| 1,706,873 | 3/1929 | Date | 312/4 |
| 1,847,066 | 3/1932 | Berg | 312/6 |
| 2,244,887 | 6/1941 | Manlel | 312/6 |
| 2,639,819 | 5/1953 | Marks | 108/149 X |
| 2,786,579 | 3/1957 | Wright | 211/96 X |
| 2,926,824 | 3/1960 | St. Clair | 211/96 X |
| 4,118,089 | 10/1978 | Johnson et al. | 312/3 X |
| 4,187,787 | 2/1980 | Nakatsu | 108/149 |

FOREIGN PATENT DOCUMENTS

| | | | |
|---|---|---|---|
| 160395 | 3/1933 | Switzerland | 312/4 |

*Primary Examiner*—James T. McCall
*Attorney, Agent, or Firm*—Henry R. Lerner

[57] ABSTRACT

A storage device having a plurality of shelves which is portable and removably supportable on a wall mount. The top wall of the device is provided, at its juncture with each sidewall, with a passageway for receiving therethrough a support rod whose rear end is removably supported on the wall mount. The front ends of the support rods are interconnected by a cross bar whereby there is defined a rectangular frame for suspending the storage device from the wall mount. The shelves are provided with rigid panels which extend rearwardly of the storage device a predetermined distance so that the rear ends of the panels abut the wall to provide added support for the device.

11 Claims, 7 Drawing Figures

PORTABLE STORAGE SHELF UNIT

BACKGROUND OF THE INVENTION

The present invention relates to a storage device having a plurality of shelves, which is easily installable in a conventional closet, is portable and thus easily removable and relocatable, and is extremely simple and economical in construction.

When additional storage shelves are required in a housing unit, such shelves are usually in the form of permanent structures, fixedly secured to a closet wall. Such permanent structures are costly to install and, more importantly, become appurtenant to the walls so that once they are installed, they cannot be removed or relocated without being totally dismantled, and cannot be reused at another location without proceeding with a new installation.

In accordance with the invention there is provided a storage device having a plurality of shelves which is adapted to be removably supported on a wall mount easily and conveniently secured to the inner wall of a closet. In my earlier U.S. Pat. No. 4,209,156 there is disclosed such wall mount adapted to pivotally support the rear ends of a plurality of lateral rods, the front free ends of which are adapted to receive and support conventional hangers. In a similar way, in accordance with the invention, the wall mount is adapted to receive the ends of at least two horizontally spaced longitudinally extending rods, which rods support the storage device. The storage device proper consists of a housing, preferably made of canvas, having a top wall, a pair of side walls, a bottom wall, and a plurality of shelves in parallel spaced relation with said top and bottom walls. At the juncture of the top wall and each side wall there is provided an appropriate passageway for receiving one of the support rods, the rear end of which terminates in a downturned portion insertable into one of the apertures on the wall mount. The front end of each support rod terminates in a hook shaped formation whereby said front ends can be interconnected by a cross member also provides at its ends with complementary hook shaped formations, for maintaining the two support rods in fixed parallel spaced relation.

In accordance with the above arrangement the storage device can easily be suspended in position in the closet merely by inserting the two support rods into the passageways at the junctures of the top and side walls, placing the downturned rear ends of the support rods in complementary apertures on the wall mount, and interconnecting the front ends of the support rod by a cross member. This will support the storage unit from its top wall permitting the entire housing to be gravitationally suspended with the shelves and the bottom wall being disposed in horizontal planes and with the side walls being disposed in substantially vertical planes whereby the shelves, including the bottom wall, are in condition to be used.

In order to rigidify the storage unit, especially when it is made of canvas, each shelf is preferably provided with a masonite stiffening board. For such purpose the frontmost edge of each shelf is provided with a lip to define a pocket for receiving the front end of the masonite stiffening board and thus to fix the same in position on the shelf and prevent it from inadvertently sliding off.

In accordance with another feature of the invention the masonite stiffening boards project rearwardly of the storage unit a sufficient distance so that when the unit is suspended as aforedescribed, the rear edges of the stiffening boards engage the closet wall, each arrangement providing added support for the storage unit, with the stiffening boards being dimensioned so that such engagement causes the entire storage unit to be suspended in straight fashion.

DESCRIPTION OF THE PREFERRED EMBODIMENTS

Figure 1:
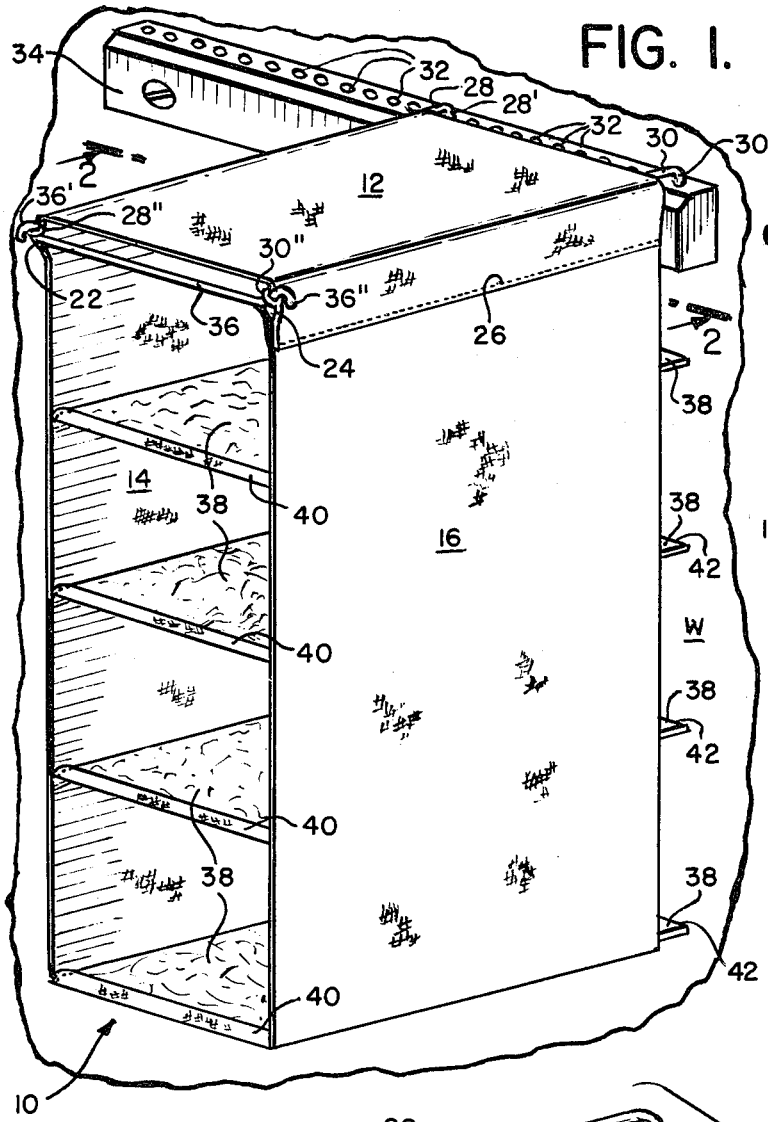
FIG. 1 is a perspective view of a portable storage shelf unit suspended on a wall mount, in accordance with the invention.
Figure 2:
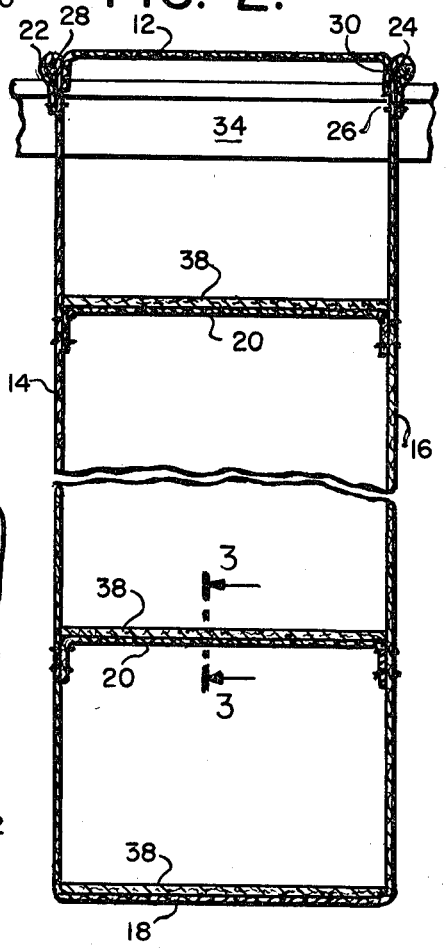
FIG. 2 is a sectional view taken along lines 2—2 of FIG. 1.

FIG. 1 illustrates a portable storage shelf unit 10 in accordance with the invention. Unit 10, which is preferably made of canvas, comprises a top wall 12, side walls 14 and 16, bottom wall 18 and a plurality of vertically spaced shelves 20 extending in horizontal planes. The top wall, side walls, bottom wall and shelves are assembled by conventional stitching, as best shown in FIG. 2.

Figure 5:
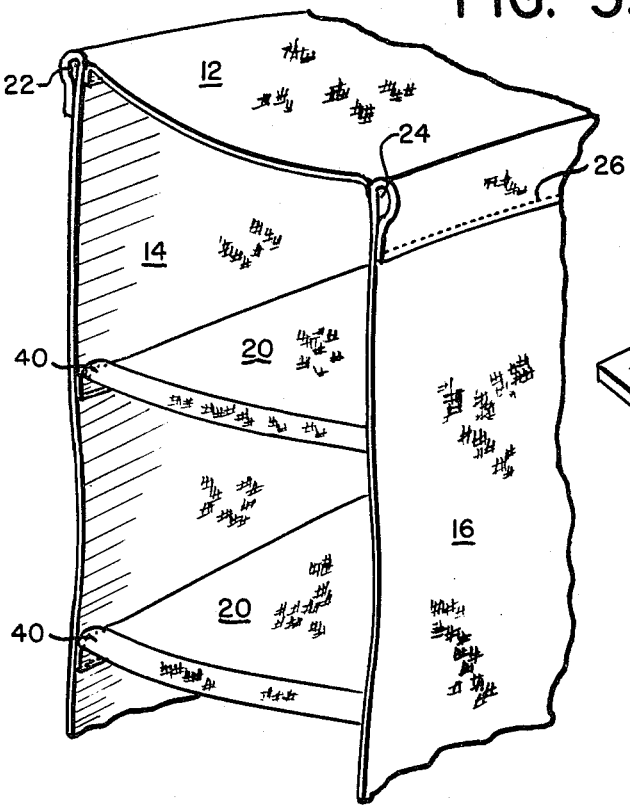
FIG. 5 is a fragmentary perspective view of the storage shelf housing.
Figure 4:
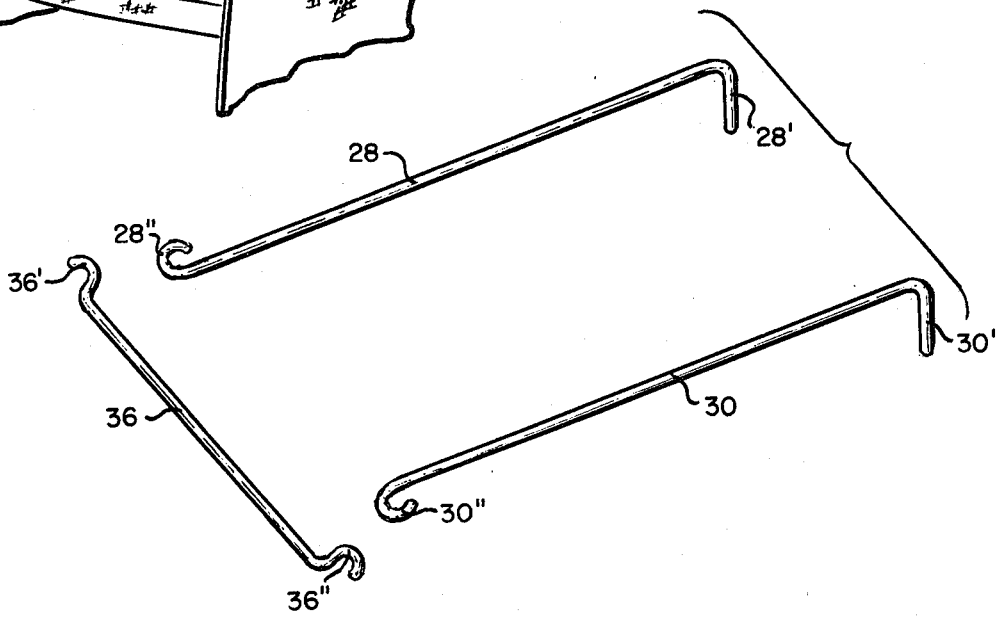
FIG. 4 is a perspective view of the support rods and the crossbar used for mounting the storage shelf unit.

A pair of passageways 22, 24 are provided at the junctures of top wall 12 and side walls 14 and 16, respectively, by folding the upper ends of side walls 14 and 16 on themselves and stitching the free ends thereof at at 26, as best shown in FIG. 5. The passageways 22 and 24 so defined extend for the entire longitudinal extent of top wall 12. A pair of supporting rods 28 and 30, best shown in FIG. 4 terminate at their rear ends with downturned portions 28' and 30' respectively, and at their front ends in hook shaped formations of 28'' and 30'' respectively. Rods 28 and 30 are threaded through their associated passageways 22 and 24, with the downturned portions 28' and 30', respectively, projecting rearwardly of unit 10, and the hook shaped formations 28'' and 30'', respectively, projecting forwardly of unit 10.

Storage shelf unit 10 can now be suspended in position by inserting downturned portions 28' and 30' into complementary apertures 32 in a mount 34 which is suitably affixed to the inner wall of the closet. Forwardly projecting formations 28'' and 30'' of the supporting rods are interconnected by cross bar 36 is provided at its opposite ends with hook shaped formations 36' and 36'', which are adapted to releasably engage formations 28'' and 30'' and thus maintain rods 28 and 30 in parallel spaced relation.

It is apparent from the above that the storage shelf unit 10 can easily be suspended on wall mount 34 at any one of a plurality of preselected locations since mount 34 is provided with a multiplicity of spaced apertures 32 for the entire extent thereof.

The supporting rods 28 and 30 cooperate with wall mount 34 and cross bar 36 to define a rectangular frame for the top wall of the storage shelf unit 10 from which the latter is suspended.

Figure 3:
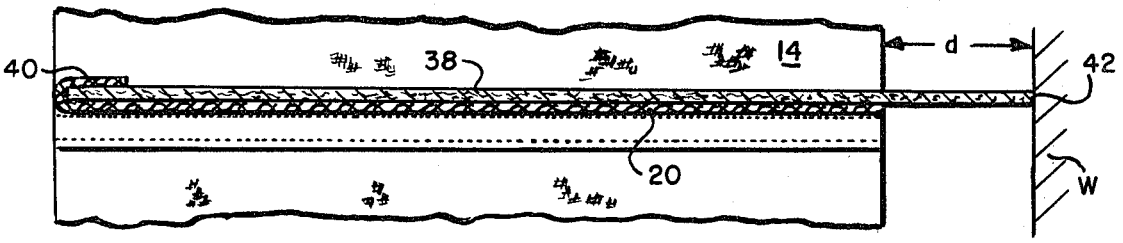
FIG. 3 is a sectional view taken along lines 3—3 of FIG. 2.
Figure 6:
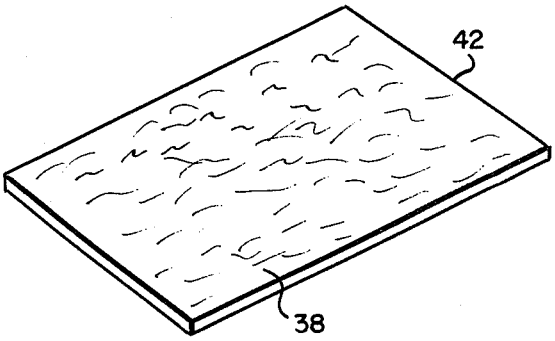
FIG. 6 is a perspective view of a masonite stiffening board for the shelves.

In order to rigidify the entire structure and particularly the shelves, the latter are provided with stiff panels 38, preferably of masonite, such as illustrated in FIG. 6, the front edges of said panels being received and retained in pockets 40 formed at the front ends of canvas shelves 20, as best shown in FIG. 3.

In accordance with another aspect of the invention panels 38 are dimensioned so as to project rearwardly of unit 10 when the front ends thereof are snugly received in pockets 40. In this way, when unit 10 is suspended on mount 34, the rear edges 42 of panels 38 engage wall W, as best seen in FIG. 3, whereby said wall provides substantial support at each such engagement for the entire storage unit 10, significantly reducing the forces acting on support rods 28 and 30 which would otherwise function purely as cantilever support elements, It will of course be understood that the extent d by which panels 38 project rearwardly of unit 10 is preselected so as to cause said unit to hang straight downwardly with the shelves being disposed in horizontal planes.

Figure 7:
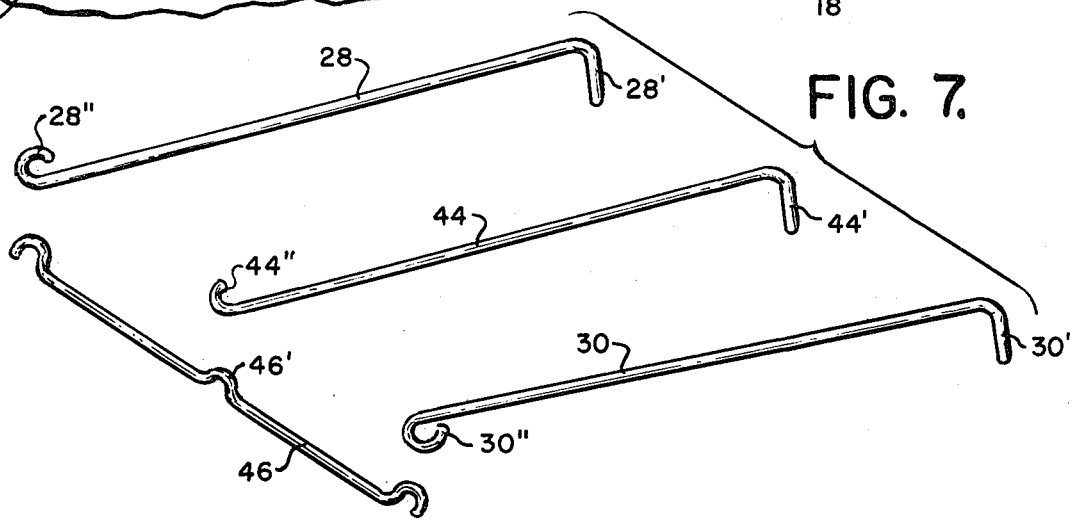
FIG. 7 is a perspective view of the support rods and crossbar used in accordance with another embodiment of the invention.

In accordance with the embodiment of the invention shown in FIG.7, there is provided an additional support rod 44 having rear downturned portions 44' and front formation 44''. Support rod 44 is located intermediate support rods 28 and 30 and downturned portion 44' is inserted in an aperture 32 in mount 34 which is intermediate the apertures which receive downturned portions 28' and 30'. Cross bar 46 is similar to cross bar 36 except that it is provided with an intermediate indentation 46' adapted to releasably engage and interlock with front formation 44'' of intermediate support rod. It will be apparent that the use of intermediate member 44 provides additional support for storage unit 10, and is preferably used where the weight of said storage unit 10 is sufficiently great to require such additional support. While an additional passageway in top wall 12 may be provided for intermediate support rod 44 such is not necessary as said rod can freely extend underneath said top wall and be maintained in fixed relation therewith by virtue of the engagement of front formation 44'' with indentation 46' on cross bar 46.

It is thus seen that the storage device in accordance with the invention as aforedescribed, is easily suspended along any wall which is provided with an apertured mount 34. In this connection, it will be noted that the same mount 34 which may be available in a housing unit for suspending hangers, in the manner described in my earlier U.S. Pat. No. 4,209,156 can be used for suspending the storage device in accordance with this invention. It will further be noted that the arrangement in accordance with the invention renders the storage device unit portable, and movable from one location to another without difficulty whatsoever, enabling the user to make more efficient and better use of closet space and wall space, without being permanently burdened with a particular arrangement, if such is desired to be changed. What is also evident is that, if so desired, the storage device unit may be totally removed and collapsed if made of canvas, ad stored away for future use enabling the closet to be used for entirely different purposes.

While the invention has been described as being particularly suitable for use in connection with a storage unit made of canvas, it will be understood that the invention herein could be equally applicable to a storage unit made of other materials, whether pliable or rigid, the essence of the invention lying in the provision of a plurality of support rods extending from the storage unit and adapted to be disposed in a wall mount from which it is easily removable and relocatable with a minimum of effort and no added cost.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of this invention within the scope of the appended claims.

Having thus described my invention, what I claim and desire to secure by letters patent is:

1. A storage device adapted to be removably supported on a wall provided with a wall mount comprising (a) a housing having a top wall, a pair of sidewalls and bottom wall, (b) a longitudinally extending passageway provided adjacent the juncture of said top wall and each of said sidewalls, (c) a support rod extending through each of said passageways and adapted to be detachably supported at its rear end on said wall mount, and (d) a cross member detachably interconnected to the front ends of said support rods for maintaining the latter is substantially parallel spaced relation, (e) said cross member, support rods and wall mount being detachable each from the other and defining, when interconnected to each other, a rectangular support frame for suspending said housing from said wall mount.

2. A storage device in accordance with claim 1, wherein said housing includes a plurality of shelves between said top and bottom wall and in parallel spaced relation therewith.

3. A storage device in accordance with claim 1, wherein said wall mount is provided with a plurality of apertures and wherein said support rods are provided at their rear ends with downturned portions adapted to be inserted in said wall mount apertures.

4. A storage device in accordance with claim 2, wherein said housing is made of a pliable material.

5. A storage device in accordance with claim 4, wherein at least one of said shelves is provided with a rigid panel substantially co-extensive therewith.

6. A storage device in accordance with claim 5, wherein said at least one of said shelves is provided with means for retaining said rigid panels in place thereon.

7. A storage device in accordance with claim 5, wherein said at least one of said shelves is provided at its front end with a lip to define a pocket in which said rigid panel is received for maintaining the latter in place on said at least one of said shelves.

8. A storage device in accordance with claim 7, wherein said panel projects rearwardly of said housing a predetermined distance so that the rear edge of said panel is in abutment against wall to define additional support for said housing.

9. A storage device in accordance with claim 8, wherein said predetermined distance is selected so as to cause said housing to hang vertically and said shelves to be disposed horizontally.

10. A storage device in accordance with claim 9, wherein said wall mount is provided with a plurality of apertures and wherein said support rods are provided at their rear ends with downturned portions adapted to be inserted in said wall mount apertures.

11. A storage device in accordance with claim 1, wherein there is provided an additional support rod intermediate said first mentioned support rods and supported at its rear end on said wall mount, and wherein said crossbar is provided with an indentation for releasably interlocking the front end of said additional support rod for maintaining the latter in spaced parallel relation with said first mentioned support rods, said additional support rod extending under the top wall of said housing.

* * * * *